US005155002A

United States Patent [19]

Osawa et al.

[11] Patent Number: 5,155,002

[45] Date of Patent: Oct. 13, 1992

[54] IMAGE FORMING METHOD

[75] Inventors: Izumi Osawa, Ikeda; Seishi Ojima, Takatsuki; Kenji Masaki, Ibaraki; Shuji Iino, Hirakata; Isao Doi, Toyonaka, all of Japan

[73] Assignee: Minolta Camera Kabushiki Kaisha, Osaka, Japan

[21] Appl. No.: 691,365

[22] Filed: Apr. 25, 1991

[30] Foreign Application Priority Data

Apr. 26, 1990 [JP] Japan ..... 2-110936

[51] Int. Cl.[5] ..... G05G 13/16

[52] U.S. Cl. ..... 430/126; 430/57; 430/58

[58] Field of Search ..... 430/58, 135, 126, 57

[56] References Cited

U.S. PATENT DOCUMENTS

| | | | |
|---|---|---|---|
| 4,533,618 | 8/1985 | Nishihama | 430/126 |
| 4,772,527 | 9/1988 | Karaishi | 430/84 |
| 4,839,697 | 6/1989 | Kamitamari et al. | 355/309 |
| 4,886,719 | 12/1989 | Tanaka et al. | 430/58 |

FOREIGN PATENT DOCUMENTS 59-162561 9/1984 Japan .

*Primary Examiner*—Marion E. McCamish
*Assistant Examiner*—Rosemary Ashton
*Attorney, Agent, or Firm*—Burns, Doane, Swecker & Mathis

[57] ABSTRACT

An image forming method comprising the steps of forming an electrostatic latent image on a photosensitive member having a surface layer containing binder resin and photosensitive material dispersed in the binder resin, supplying charged toner particles to the above electrostatic latent image to form a toner image on the above photosensitive member, conveying paper toward the surface of the above photosensitive member to engage the paper with the above toner image, and transferring the toner image formed on the photosensitive member to the above paper, the relationship among the normal velocity (N) [mm/sec] of the paper which is defined by the formula of (v) sin $\theta$, and the thickness (T) [$\mu$m] and the Vickers hardness (V) of the surface layer of the above photosensitive member satisfying the condition of $T \cdot (V/N)^{0.1} 20$ when the above paper is conveyed to the surface of the photosensitive member at a speed of v [mm/sec] and is brought into contact with the surface of the photosensitive member at a contact angle of $\theta$ [degrees].

12 Claims, 6 Drawing Sheets

IMAGE FORMING METHOD

BACKGROUND OF THE INVENTION

1. Field of the Invention

The present invention relates generally to an image forming method in which an image is formed by forming an electrostatic latent image on a photosensitive member provided with a surface layer containing photosensitive material, supplying toner particles to the electrostatic latent image to form a toner image on the surface of the photosensitive member, while conveying transfer paper to the surface of the above photosensitive member having the toner image formed thereon, bringing the transfer paper into contact with the surface of the photosensitive member at a suitable contact angle and then, transferring the above toner image formed on the surface of the photosensitive member to the transfer paper, and more particularly, to an image forming method using as the above photosensitive member an organic photosensitive member provided with a surface layer containing binder resin and photosensitive material dispersed in the binder resin.

2. Description of the Prior Art

In an image forming apparatus such as an electrophotographic copying machine, a printer or a facsimile, an image forming method has been conventionally adopted in which an image is formed by forming an electrostatic latent image on a photosensitive member provided with a surface layer containing photosensitive material, supplying toner particles to the electrostatic latent image to form a toner image on the surface of the photosensitive member, while conveying transfer paper to the surface of the above photosensitive member having the toner image thus formed thereon, bringing the transfer paper into contact with the surface of the photosensitive member at a suitable contact angle and then, transferring the above toner image formed on the surface of the photosensitive member to the transfer paper.

In this image forming method, a photosensitive member using as photosensitive material in its surface layer inorganic photosensitive material such as selenium, cadmium sulfide or zinc oxide has been generally used.

However, the photosensitive member using selenium, for example, has the disadvantages. For example, the proper conditions for manufacturing are so severe that it is difficult to manufacture the photosensitive member and the manufacturing cost is high. In addition, the selenium photosensitive member has poor resistance to heat and mechanical impact so that handling is required to be careful.

Furthermore, the photosensitive member using zinc oxide and the photosensitive member using cadmium sulfide have the disadvantages. For example, stable sensitivity is not obtained in the humid environment. In addition, when coloring material is added as a sensitizing agent to photosensitive layers of the photosensitive members, the coloring material is degraded in charging the photosensitive members by corona discharge or is discolored in exposing the photosensitive members, thereby to make it impossible to hold stable photosensitivity for a long time.

Therefore, as the result of various studies and developments of the photosensitive members, an organic photosensitive member has been developed in recent years so adapted that photosensitive material having various types of photosensitive material, for example, charge generating material for generating charges by irradiation of light and charge transporting material for transporting the charges generated is dispersed in suitable binder resin to form a surface layer. Such an organic photosensitive member has been widely utilized in an image forming apparatus such as an electrophotographic copying machine because it can be manufactured at low cost and has high sensitivity.

More specifically, the above described organic photosensitive member can easily use a combination of various types of photosensitive material, because various types of photosensitive material can be dispersed in binder resin. The combination of the types of photosensitive material makes it possible to rapidly improve the sensitivity. Further, in preparing this organic photosensitive member, low-cost binder resin can be used. Accordingly, the raw material cost is low. Furthermore, the above photosensitive material is dispersed in a solution obtained by dissolving binder resin in a suitable solvent, and a dispersion thus obtained is applied by a coating method such as spray coating or dip coating, thereby to make it possible to simply form a surface layer having photosensitivity on the surface of the photosensitive member. Accordingly, the photosensitive member can be easily mass-produced, and the manufacturing cost is low.

In such an organic photosensitive member, the surface layer is formed by dispersing the photosensitive material, such as charge transporting material and charge generating material, in the binder resin as described above, so that the hardness of the surface layer on its surface is generally lower than that in the above described photosensitive member using the inorganic photosensitive material due to the softness of the binder resin.

On the other hand, as the above described transfer paper, plain paper containing as loading material an inorganic compound such as clay, talc, titanium white or calcium carbonate in addition to fiber tissue such as cellulose or hemicellulose has been utilized so as to adjust the opacy, whiteness, smoothness, height and the like of the paper.

When this plain paper is conveyed to the organic photosensitive member whose surface layer has a low hardness as described above and is brought into contact with the surface layer of the photosensitive member at a suitable contact angle, the above loading material contained in the plain paper may, in some cases, be embedded in the surface layer of the above photosensitive member.

Particularly in recent years, it has been desired to increase the speed at which an image is formed so that large numbers of copies can be made in a short time with increasing demand for copying. Consequently, the speed of the plain paper which is conveyed to the surface of the photosensitive member is increased and the force exerted when the plain paper is brought into contact with the surface of the above photosensitive member becomes large, so that the above loading material contained in the plain paper is embedded in the surface layer more easily.

Furthermore, regenerated paper has been frequently utilized in recent years in terms of the effective utilization of good resources.

The regenerated paper is generally stiffer than the above plain paper, and contains loading material comprising an inorganic compound such as clay or talc in larger quantities than the plain paper so as to increase the whiteness after regeneration. More specifically, in the above plain paper, the stiffness ($L^3/100$) measured by a Clark stiffness tester in the TAPPI standard test of T 451 regulation is approximately 40 to 120, and the ash content representing the content of the above loading material comprising the inorganic compound is 5 to 15% by weight. On the other hand, in the regenerated paper recently used, the above stiffness ($L^3/100$) is approximately 180 to 450, and the above ash content is 20 to 40% by weight.

Therefore, hen the above regenerated paper is used as the transfer paper, the above loading material is embedded in larger quantities in the surface layer of the above organic photosensitive member.

If the loading material is thus embedded in &he surface layer of the photosensitive member, light incident on the photosensitive member is interrupted by the loading material embedded. Consequently, the sensitivity of the photosensitive member in a portion where the loading material is embedded is lowered, and an image formed is made irregular in density, for example, to lower the quality of the image formed.

SUMMARY OF THE INVENTION

An object of the present invention is to prevent, when transfer paper is brought into contact with a surface layer formed on the surface of an organic photosensitive member in forming an image using the photosensitive member, loading material comprising an inorganic compound such as clay, talc, titanium white or calcium carbonate contained in the transfer paper from being embedded in the above surface layer, to make it possible to obtain a good image for a long time.

Another object of the present invention is to make it possible to stably obtain, in forming an image using an organic photosensitive member, a good image even when the speed at which an image is formed is increased.

Still another object of the present invention is to make it possible to stably obtain a good image even when regenerated paper being stiffer and containing the above loading material comprising the inorganic compound in larger quantities than plain paper is used as transfer paper.

An image forming method according to the present invention uses an organic photosensitive member having a surface layer formed by dispersing photosensitive material in binder resin. In forming an image by forming an electrostatic latent image on the surface of the photosensitive member and then, supplying toner particles to the electrostatic latent image to form a toner image on the surface of the above photosensitive member, while conveying transfer paper so as to come into contact with the surface of the above photosensitive member, and transferring the above toner image formed on the surface of the photosensitive member to the transfer paper, the relationship among the normal velocity (N) [mm/sec] which is defined by the formula of (v) sin ($\theta$), and the thickness (T) [$\mu$m] and the Vickers hardness (V) of the surface layer of the above photosensitive member is set to satisfy the following expression ]1] when the transfer paper is conveyed to the surface of the above photosensitive member at a speed of (v) [mm/sec] and is brought into contact with the surface of the photosensitive member at a contact angle of ($\theta$) [degrees]:

$$T\cdot(V/N)^{0.1} \geqq 20 \qquad [1]$$

In a case where an image is formed by adjusting the thickness T [$\mu$m] and the Vickers hardness (V) of the surface layer of the photosensitive member, the speed (v) [mm/sec] of the transfer paper which is conveyed to the surface of the photosensitive member and the contact angle ($\theta$) [degrees] at which the transfer paper is brought into contact with the surface of the photosensitive member as described above, even when the hardness of the above surface layer is low, the transfer paper is brought into contact with the surface layer at high speed, and regenerated paper or the like being stiff and containing the loading material comprising the inorganic compound such as clay or talc in large quantities is used as the transfer paper, the possibility is reduced that the loading material or the like contained in the transfer paper is embedded in the surface layer of the above photosensitive member when the transfer paper is brought into contact with the surface layer.

As a result, when an image is formed on the basis of the image forming method according to the present invention, a good image is obtained for a long time even when the speed at which an image is formed is increased using the organic photosensitive member or the regenerated paper is used as the transfer paper.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Photosensitive members shown in FIGS. 1 to 5, for example, can be used in the present invention.

Figure 1:
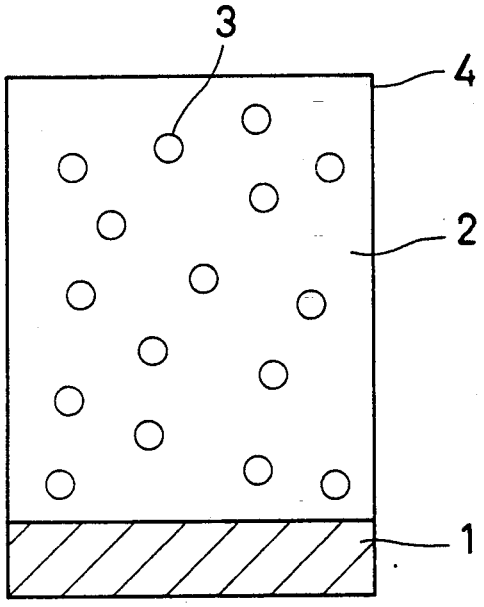
FIG. 1 is a schematic diagram showing a structure of a first organic photosensitive member used in the present invention.

A photosensitive member shown in FIG. 1 has a structure in which a photosensitive layer 4 comprising binder resin 2 and photosensitive material 3 dispersed in the binder resin 2 is formed on an electrically conductive substrate 1.

Figure 2:
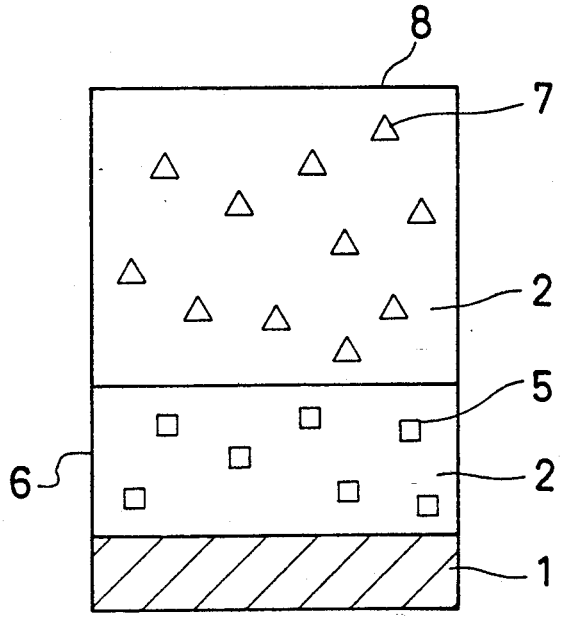
FIG. 2 is a schematic diagram showing a structure of second organic photosensitive member used in the present invention.

A photosensitive member shown in FIG. 2 has a structure in which a charge generating layer 6 comprising binder resin 2 and charge generating material 5 dispersed in the binder resin 2 and a charge transporting layer 8 comprising binder resin 2 and charge transporting material 7 dispersed in the binder resin 2 are laminated on an electrically conductive substrate 1.

Figure 3:
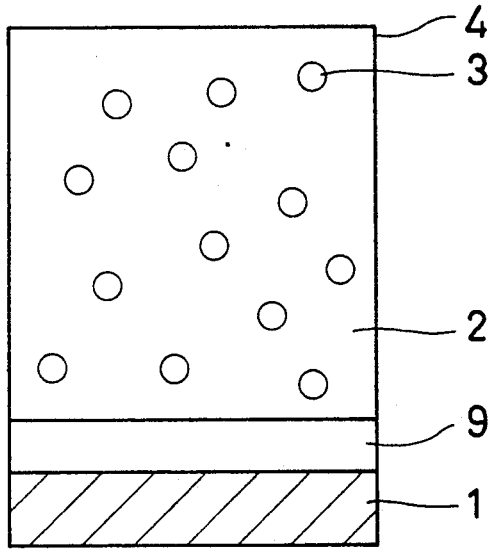
FIG. 3 is a schematic diagram showing a structure of a third organic photosensitive member used in the present invention.

A photosensitive member shown in FIG. 3 has a structure in which an intermediate layer 9 comprising resin, an inorganic compound or the like is provided between an electrically conductive substrate 1 and the above photosensitive layer 4 so as to improve rectification properties and adhesive properties.

Figure 4:
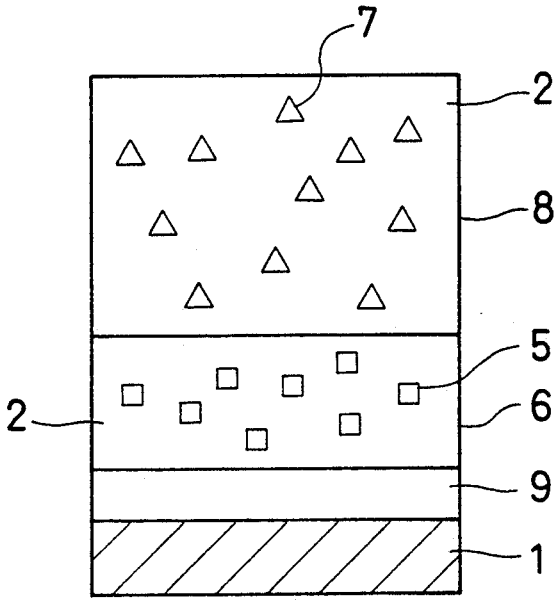
FIG. 4 is a schematic diagram showing a structure of a fourth organic photosensitive member used in the present invention.

A photosensitive member shown in FIG. 4 has a structure in which the above intermediate layer 9, the above charge generating layer and the above charge transporting layer 8 are laminated in that order on an electrically conductive substrate 1.

Figure 5:
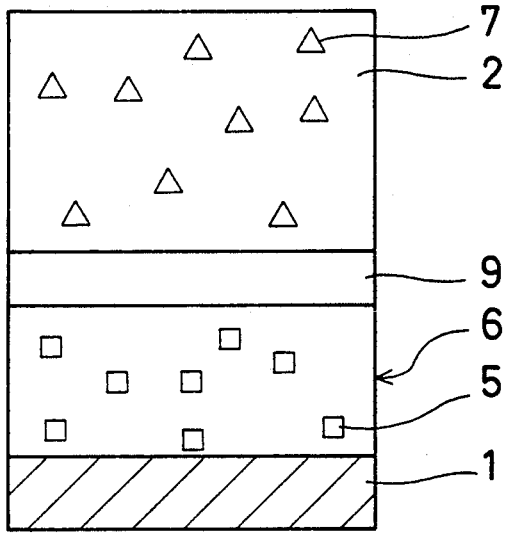
FIG. 5 is a schematic diagram showing a structure of a fifth organic photosensitive member used in the present invention.

A photosensitive member shown in FIG. 5 has a structure in which the above charge generating layer 6, the above intermediate layer 9 and the above charge transporting layer 8 are laminated in that order on an electrically conductive substrate 1.

A surface layer of each of the photosensitive members is a layer constructed by dispersing any photosensitive material in binder resin and located on the uppermost surface of the photosensitive member, which corresponds to the above photosensitive layer 4 in the photosensitive members shown in FIGS. 1 and 3, while corresponding to the above charge transporting layer 8 in the photosensitive members shown in FIGS. 2, 4 and 5.

The thickness (T) [μm] and the Vickers hardness (V) of the surface layer respectively indicate the thickness (T) [μm] and the Vickers hardness (V) of the photosensitive layer 4 or the charge transporting layer 8 located on the uppermost surface as described above. The thickness (T) [μm] of the above surface layer can be measured using, for example, a film thickness meter EC-8e2Ty (trade name) produced by Fisher Company, and the Vickers hardness of the above surface layer can be measured using a thin film hardness meter MHA-400 (trade name) produced by NEC Corporation.

Furthermore, in the present invention, it is possible to use, as the above described binder resin used in the photosensitive member, thermoplastic resin such as polycarbonate resin, acrylic resin, methacrylate resin, polyester resin, polystyrene resin and silicone resin and various types of thermosetting resin. Particularly, polycarbonate resin and polyester resin are preferable in that they are worn but is hardly damaged.

Additionally, it is preferable to use, as the above described charge generating material, various types of organic charge generating material such as azo pigments, phthalocyanine pigments, quinacridone pigments, perylene pigments, polycyclic quinone pigments, indigo pigments, benzimidazole pigments, pyrylium salt dyes, thiapyrylium salt dyes and squalylium salt dyes. In addition, in providing the above described charge generating layer using the charge generating material, a uniform layer may be formed by dispersing fine particles of the charge generating material in binder resin besides forming a uniform layer by vacuum vapor deposition and plasma vapor deposition of the charge generating material. It is possible to use, as the binder resin in this case, various types of binder resin such as polyvinyl acetate, polyacrylic ester, polymethacrylic ester, polyester, polycarbonate, polyvinyl butyral, phenoxy resin, cellulose resin and urethane resin. In addition, as the above charge generating layer, a layer having a thickness of 0.1 to 1 μm is generally provided.

Furthermore, it is possible to use, as the above described charge transporting material, electron-attracting material such as trinitrofluorenone and tetracyanoquinodimethane, heterocyclic compounds such as carbazole, indole, imidazole, oxazole, thiazole, oxadiazole, pyrazole and pyrazoline, and electron-releasing material such as an aniline derivative, a hydrazone derivative and a stilbene derivative. Furthermore, various additives may be added to the above charge transporting layer so as to, for example, improve film forming properties and restrain the residual potential.

Additionally, as shown in FIGS. 3 and 4, when the intermediate layer 9 is provided on the electrically conductive substrate 1, a layer of a metal oxide such as anodized aluminium oxide or resin layer composed of polyamide, polyurethane, cellulose or casein can be provided as this intermediate layer 9.

Figure 6:
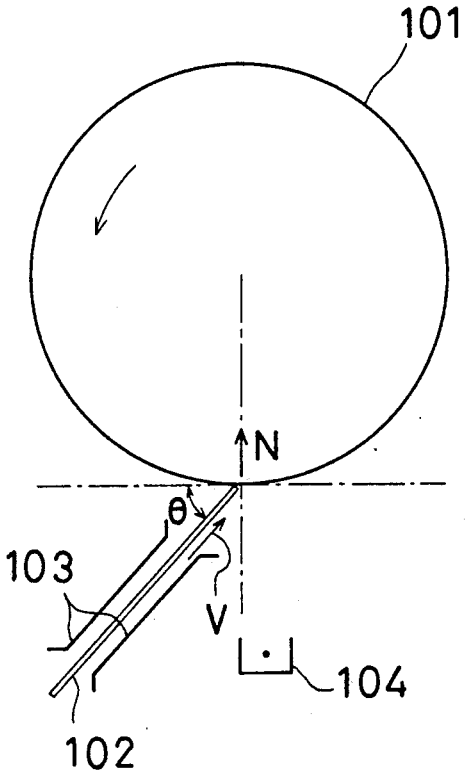
FIG. 6 is a diagram showing a state where transfer paper is in contact with the surface of a cylindrical photosensitive member.
Figure 7:
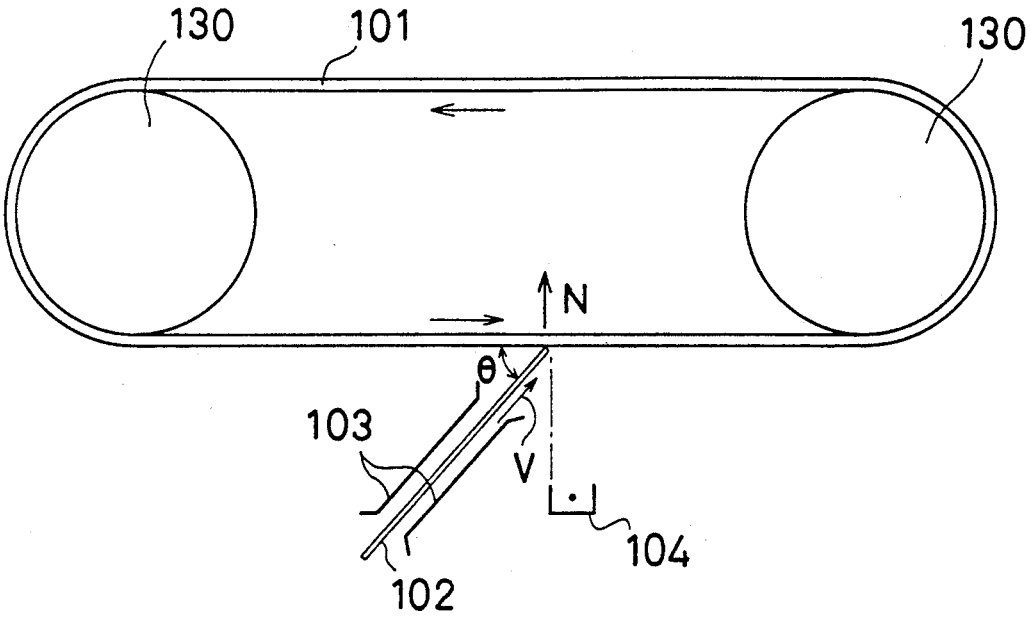
FIG. 7 is a diagram showing a state where transfer paper is in contact with the surface of a belt-shaped photosensitive member.

Moreover, the photosensitive member according to the present invention may be cylindrical as shown in FIG. 6 or in an endless belt shape as shown in FIG. 7.

In the case shown in FIG. 6, in conveying transfer paper 102 so as to come into contact with the surface of a cylindrical photosensitive member 101, the above transfer paper 102 is conveyed to the surface of the rotating photosensitive member 101 through a guide plate 103 at the same speed of (v) [mm/sec] as the peripheral speed of the above photosensitive member 101 to bring this transfer paper 102 into contact with the surface of the photosensitive member 101 at a suitable contact angle of ($\theta$) [degrees].

On the other hand, in the case shown in FIG. 7, in conveying transfer paper 102 so as to come into contact With the surface of a photosensitive member 101 in an endless belt shape, the above photosensitive member 101 in an endless belt shape is wound around a pair of rotary rollers 130 which are provided with constant spacing so that the photosensitive member 101 is moved at suitable speed as the above rollers 130 are rotated. In a suitable position between the above rollers 180 of the photosensitive member 101 thus moved, the transfer paper 102 is conveyed to the surface of the photosensitive member 101 through a guide plate 103 at the same speed of (v) [mm/sec] as the speed in which the above photosensitive member 101 is moved to bring this transfer paper 102 into contact with the surface of the photosensitive member 101 at a suitable contact angle of ($\theta$) [degrees].

Figure 8:
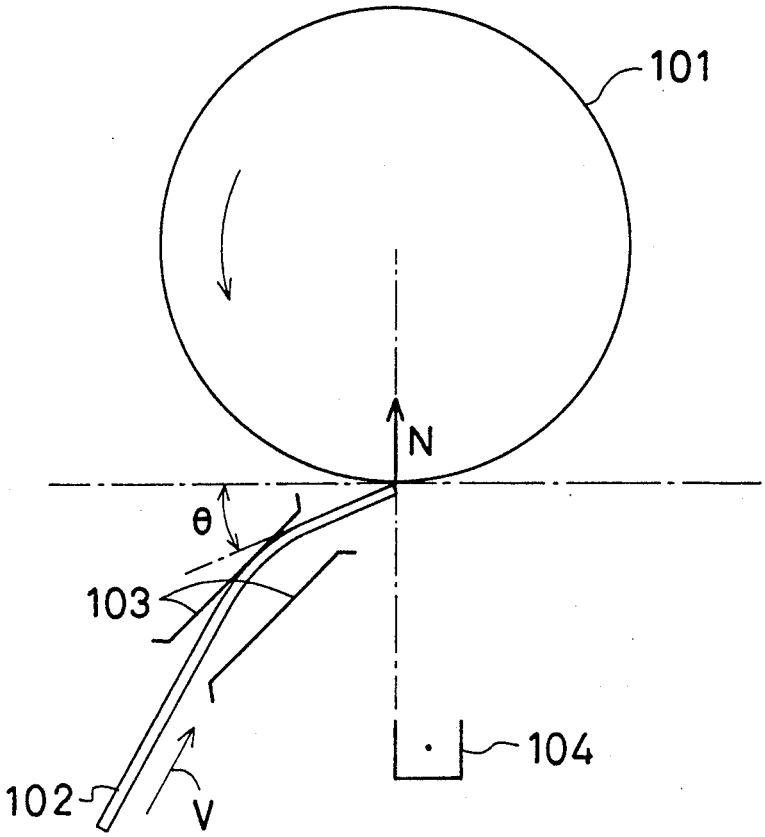
FIG. 8 is a diagram showing a state where transfer paper is in contact with the surface of a cylindrical photosensitive member after colliding with a guide plate.

Herein, the above contact angle ($\theta$) [degrees] means an angle at the time point where the transfer paper 102 comes into contact with the surface of the photosensitive member 101. Therefore, when the transfer paper 102 collides with the guide plate 103 to shift the direction in which the transfer paper 102 is conveyed, as shown in FIG. 8, the above contact angle ($\theta$) [degrees] means an angle at the time point where the transfer paper 102 collides with the guide plate 103 and then, comes into contact with the surface of the photosensitive member 101.

The above described normal velocity (N) [mm/sec] is found by the following equation [2] from the contact angle ($\theta$) [degrees] thus determined and the moving speed (v) [mm/sec] of the above transfer paper 102:

$$N=(v)\sin(\theta) \quad 2$$

Furthermore, as shown in FIGS. 6 and 7, the transfer paper 102 is brought into contact with the surface of the photosensitive member 101 at a suitable contact angle of ($\theta$) [degrees] and then, charges having opposite polarity to toner particles are applied from the reverse side of the above transfer paper 102 to transfer a toner image formed on the surface of the above photosensitive member 101 to the surface of the transfer paper 102 by a transferring corona discharger 104 provided on the reverse side of the transfer paper 102.

In the image forming method according to the present invention, the thickness (T) [$\mu$m] and the Vickers hardness (V) of the surface layer of the photosensitive member, and the normal velocity (N) [mm/sec] which are defined as described above are adjusted so as to satisfy the foregoing expression [1], i.e., $T\cdot(V/N)^{0.1}\geqq 20$, thereby to find that loading material comprising an inorganic compound such as clay, talc, titanium white or calcium carbonate contained in the transfer paper is prevented from being embedded in the surface layer of the above organic photosensitive member.

In a case where the thickness (T) [$\mu$m] and the Vickers hardness (V) of the surface layer of the photosensitive member, and the normal velocity (N) [mm/sec] are thus adjusted so as to satisfy the foregoing expression [1] hen an image is formed using as the transfer paper plain paper generally used, the loading material comprising the inorganic compound such as clay or talc contained in the plain paper is prevented from being embedded in the surface layer of the above organic photosensitive member. On the other hand, even when an image is formed using paper such as regenerated paper being stiffer and containing the loading material comprising the inorganic compound such as clay or talc in larger quantities than the above plain paper, the loading material comprising the inorganic compound such as clay or talc is prevented from being embedded in the surface layer of the above organic photosensitive member. For example, even when an image is formed using regenerated paper having stiffness of approximately 180 to 450 measured by a Clark stiffness tester in the TAPPI standard test of T 451 regulation, having an ash content as described later of 20 to 40% by eight and containing loading material to be ash which is 1.5 to 8 times as much as that in the above plain paper, the loading material is prevented from being embedded in the surface layer of the above photosensitive member.

The above ash content is measured in a method based on JIS-P-8128 as described below First, a sample of 1 to 2 g in weight is thoroughly dried at 105°±3° C., is cooled in a desiccator and then, is weighed to the nearest 1 mg, is put in a crucible with a cover having a known weight, and is gradually heated using an electric furnace, finally to an ignition temperature of approximately 900° C. The sample is completely ashed until a black or brown portion cannot be seen in ash even if it is cooled after ignition. When the amount of ash is large, the ash is divided by a platinum bar to confirm whether the sample is completely ashed. In this case, stiff black ash created due to the existence of salt easily dissolved is humidified by a supernatant liquid of hydrogen peroxide or ammonium nitrate and is ignited again, thereby to make it possible for the black ash to disappear. The sample is cooled by the desiccator after ashing to measure the amount of the ash. The ash content is calculated by the following equation [3] on the basis of the absolute dry weight:

$$A(\%)=(W/S)\times 100 \quad [3]$$

where A denotes ash content (%), S denotes absolute dry weight (g), and W denotes weight (g) of ash.

Furthermore, the thickness (T) and the Vickers hardness (V) of the surface layer of the photosensitive member and the normal velocity (N) in the above described expression [1] respectively have preferred ranges, and the values are determined in consideration of the interrelationship.

It is preferable to increase the thickness (T) of the surface layer from the point of view of preventing the above loading material from being embedded. If the surface layer is made thick, however, resistance to the movement of charges is increased to lower the sensitivity of the photosensitive member.

Furthermore, it is preferable to increase the Vickers hardness (V) of the surface layer from the point of view of preventing the above loading material from being embedded. In order to make the hardness high, however, binder resin having high insulating properties must be generally used. Also in this case, resistance to the movement of charges is increased to lower the sensitivity of the photosensitive member.

Consequently, in the photosensitive member, the thickness (T) and the Vickers hardness (V) of the surface layer must be determined in a well balanced manner in consideration of the prevention of embedding of the loading material in the surface layer and the sensitivity of the photosensitive member.

Furthermore, if the above normal velocity (N) is increased, the speed at which an image is formed can be increased. However, a photosensitive member superior in sensitivity must be used. In addition, impact at the time of the contact with the photosensitive member becomes great. Accordingly, the loading material is easily embedded in the surface layer of the photosensitive member. On the other hand, if the normal velocity (N) is decreased, the loading material is not easily embedded in the surface layer of the photosensitive member. However, the speed at which an image is formed is reduced, thereby to make it impossible to cope with higher speed.

When the thickness (T) and the Vickers hardness (V) of the surface layer of the photosensitive member and the normal velocity (N) are collectively considered, it is desirable that the thickness (T) [$\mu$m] of the surface layer is approximately 10 $\mu m\leqq T\leqq 100$ $\mu$m, preferably 30 $\mu m\leqq T\leqq 60$ $\mu$m, the Vickers hardness (V) of the surface layer is approximately $4\leqq V\leqq 80$, and the normal velocity (N) [mm/sec] is approximately 30 mm/sec$\leqq N\leqq 600$ mm/sec.

Furthermore, it is preferable that the value of $T\cdot(V/N)^{0.1}$ is larger from the point of view of preventing the loading material from being embedded in the surface layer of the photosensitive member. If the thickness (T) of the surface layer becomes larger than 100 $\mu$m and the Vickers hardness (V) of the surface layer becomes higher than 80, however, the sensitivity is lowered. In addition, when the above normal velocity (N) is lower than 30 mm/sec, the speed at which an image is formed is reduced. Consequently, it is preferable that the above value of $T\cdot(V/N)^{0.1}$ is in the following range:

$$20 \leqq T\cdot(V/N)^{0.1} \leqq 100(80/30)^{0.1} \approx 110$$

Figure 9:
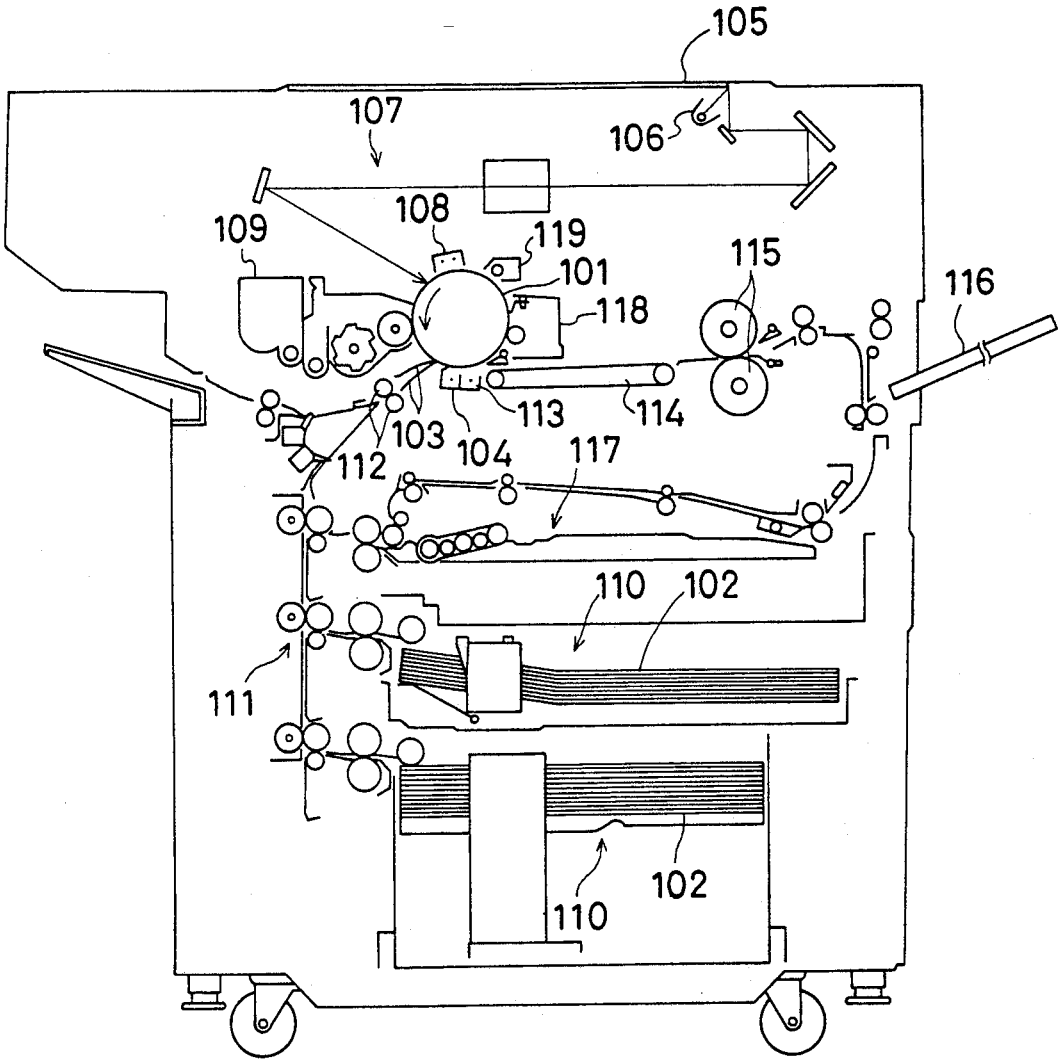
FIG. 9 is a schematic diagram for explaining an electrophotographic copying machine used for conducting experiments according to the present invention.

FIG. 9 is a schematic diagram for explaining an electrophotographic copying machine used for conducting experiments in the image forming method according to the present invention. This electrophotographic copying machine is a conversion of an electrophotographic copying machine EP8600 (trade name) produced by Minolta Camera Co., Ltd.

In this electrophotographic copying machine, a photosensitive member 101 is rotated in the direction represented by an arrow, to negatively charge the surface of the photosensitive member 101 by a charger 108. In addition, light is irradiated from a light source 106 to a document (not shown) placed on platen glass 105 and its reflected light is projected to the surface of the above charged photosensitive member 101 by an optical system 107, to form an electrostatic latent image on the photosensitive member 101.

Then, toner particles positively charged are supplied from a developing device 109 to the above electrostatic latent image formed on the photosensitive member 101, to form a toner image on the photosensitive member 101. This toner image is introduced into a position opposed to a transferring corona discharger 104 for discharging negative charges by the rotation of the photosensitive member 101.

On the other hand, transfer paper 102 is conveyed to a pair of timing rollers 112 by a conveying system 111 including various rollers from a paper feeding unit 110. The above timing rollers 112 are rotated as the above photosensitive member 101 having the toner image formed thereon is rotated, to introduce the above transfer paper 102 through a guide plate 103 so as to come into contact with the surface of the photosensitive member 101 at a suitable contact angle. The above guide plate 103 is provided so as to introduce the transfer paper 102 into the position of the photosensitive member 101 which is opposed to the transferring corona discharger 104.

When the above transfer paper 102 is brought into contact with the surface of the photosensitive member 101, this transfer paper 102 is attracted by electrostatic attraction of the toner image formed on the photosensitive member 101 and is moved while being in contact with the photosensitive member 101. Negative charges having opposite polarity to the above toner particles are discharged toward the transfer paper 102 from the above transferring corona discharger 104 located spaced apart from the transfer paper 102, to transfer the toner image formed on the photosensitive member 101 onto the transfer paper 102.

Thereafter electrostatic attraction between the photosensitive member 101 and the transfer paper 102 is weakened by the alternating current discharge toward the above transfer paper 102 from a separating corona discharger 113 provided on the downstream side of the above transferring corona discharger 104 in the direction of the rotation of the photosensitive member 101, to separate the transfer paper 101 from the photosensitive member 101.

The transfer paper 102 separated is conveyed to a fixing roller 115 by a conveying system 114, to fix to the transfer paper 102 the toner image transferred to the transfer paper 102 by applying heat and pressure using the fixing roller 115. Thereafter, the transfer paper 102 is discharged to a paper discharge tray 116 or is introduced into a duplex copy unit 117.

When the above transfer paper 102 is introduced into the duplex copy unit 117, the transfer paper 102 is returned to the above conveying system 111 with it being tuned over. Thereafter, the toner image is fixed to the reverse surface of the transfer paper 102 through the same process as the above described process and then, the transfer paper 102 is discharged to the paper discharge tray 116.

With respect to the photosensitive member 101 from which the transfer paper 12 has been separated by the separating corona discharger 113 as described above, the toner particles which remain on the surface of the photosensitive member 101 are removed by a cleaner 118 and then, light is irradiated to the surface of the photosensitive member 101 from an eraser lamp 119, to remove the residual potential on the surface of the photosensitive member 101.

Various experiments as described later are then conducted by altering the thickness (T) [μm] and the Vickers harness (V) of the surface layer of the photosensitive member, and the normal velocity (N) [mm/sec], to compare the experiments which satisfy and do not satisfy the condition of the above described expression [1], i.e., $T\cdot(V/N)^{0.1} \leqq 20$.

In conducting the following experiments, five types of photosensitive members whose surface layers respectively have different Vickers hardnesses V of 5, 15, 30, 50, and 70 are first prepared as organic photosensitive members in the following manner, and the thickness T [μm] of the surface layer of each of the photosensitive members is set to 40, 38, 36, 34, 32, 30, 28, 26, 24, 22, 20, 18, and 16.

The Vickers hardness V of the surface layer of each of the photosensitive members is measured using a thin film hardness meter MHA-400 (trade name) produced by NEC Corporation, and the thickness T [μm] of the surface layer is measured using a film thickness meter EC8e2Ty (trade name) produced by Ficher Company.

Preparation of Photosensitive Member having Vickers Hardness of 50

First, a mixture containing one part by weight of bisazo pigment chlorodian blue (CDB), one part by weight of polyester resin (V200; product of Toyobo Co., Ltd.) and 100 part by weight of cyclohexanone is dispersed for 13 hours using a sand grinder and then, a dispersion thus obtained is applied to an aluminium substrate in a cylindrical shape having a diameter of 100 mm and having a length of 340 mm using a dipping device commonly used and is dried, to form a charge generating layer having a thickness of 0.3 μm.

Then, a solution obtained by dissolving one part by weight of 4-dimethylaminobenzaldehyde-diphenylhydrazone (DEH) and one part by weight of polycarbonate (K-1300; product of Teijin Kasei Co., Ltd.) in 6 part by weight of THF is applied to the above charge generating layer and is dried, to form a charge transporting layer having a Vickers hardness of 50 as a surface layer on the charge generating layer.

Furthermore, in forming the charge transporting layer on the charge generating layer as described above, the amount of application of the above solution is adjusted, to prepare photosensitive members whose charge transporting layers respectively have thicknesses T [μm] of 40, 38, 36, 34, 32, 30, 28, 26, 24, 22, 20, 18, and 16.

Preparation of Photosensitive Member having Vickers Hardness of 30

A charge transporting layer having a Vickers hardness of 30 is formed as a surface layer on the above described charge generating layer in the same manner as in the preparation of the above described photosensitive members having a Vickers hardness of 50 except that 0.5 part by weight of polycarbonate is used for forming the charge transporting layer.

Furthermore, photosensitive members whose charge transporting layers respectively have thicknesses T [μm] of 40, 38, 36, 34, 32, 30, 28, 26, 24, 22, 20, 18, and 16 are prepared in the same manner as the above photosensitive members having a Vickers hardness of 50.

Preparation of Photosensitive Member having Vickers Hardness of 15

A charge transporting layer having a Vickers hardness of 15 is formed as a surface layer on the above described charge generating layer in the same manner as in the preparation of the above described photosensitive members having a Vickers hardness of 50 except that one part by weight of polyester resin (V-200; product of Toyobo, Co., Ltd.) is used in place of polycarbonate used for forming the charge transporting layer.

Furthermore, photosensitive members whose charge transporting layers respectively have thicknesses T [μm] of 40, 38, 36, 34, 32, 30, 28, 26, 24, 22, 20, 18, and 16 are prepared in the same manner as the above photosensitive members having a Vickers hardness of 50.

Preparation of Photosensitive Member having Vickers Hardness of 5

A charge transporting layer having a Vickers hardness of 5 is formed as a surface layer on the above described charge generating layer in the same manner as in the preparation of the above described photosensitive members having a Vickers hardness of 50 except that 0.5 part by weight of polyester resin (V-200; product of Toyobo Co., Ltd.) is used in place of polycarbonoate used for forming the charge transporting layer.

Furthermore, photosensitive members whose charge transporting layer respectively have thicknesses T [μm] of 40, 38, 36, 34, 32, 30, 28, 26, 24, 22, 20, 18, and 16 are also prepared in the same manner as the above photosensitive members having a Vickers hardness of 50.

Preparation of Photosensitive Member having Vickers Hardness of 70

A charge transporting layer having a Vickers hardness of 70 is formed as a surface layer on the above described charge generating layer in the same manner as in the preparation of the above described photosensitive members having a Vickers hardness of 50 except that one part by weight of methyl methacrylate PMMA (BR-85; product of Mitubishi Rayon Co., Ltd.) is used in place of polycarbonate used for forming the charge transporting layer.

Furthermore, photosensitive members whose charge transporting layers respectively have thicknesses T [μm] of 40, 38, 36, 34, 32, 30, 28, 26, 24, 22, 20, 18 and 16 are also prepared in the same manner as the above photosensitive members having a Vickers hardness of 50.

Additionally, in the following experiments, the above normal velocity N [mm/sec] at the time point where the transfer paper 102 comes into contact with the surface of the photosensitive member 101 is adjusted by altering the speed (v) [mm/sec] at which the transfer paper 102 is fed to the surface of the photosensitive member 101 or altering using the guide plate 103 the contact angle $\theta$ at which the transfer paper 102 is brought into contact with the surface of the photosensitive member 101 in FIG. 6.

Experiments 1 to 13

In the experiments, 13 types of photosensitive members prepared in the above described manner whose charge transporting layers have a Vickers hardness V of 5 and respectively have thicknesses T [μm] of 40, 38, 36, 34, 32, 30, 28, 26, 24, 22, 20, 18 and 16 are used as organic photosensitive members.

On the other hand, regenerated paper having stiffness ($L^3/100$) of 200 measured by a Clark tester and having a wastepaper content of 50% and the above ash content of 21% by weight is used as transfer paper.

In feeding the transfer paper so as to come into contact with the surface of each of the above photosensitive members such adjustments are made that the speed (v) at which the transfer paper is fed is 192 mm/sec, the contact angle $\theta$ at which the transfer paper is brought into contact with the surface of the photosensitive member is 15°, and the normal velocity N of the transfer paper which comes into contact with the surface of the photosensitive member is 50 mm/sec.

Figure 10:
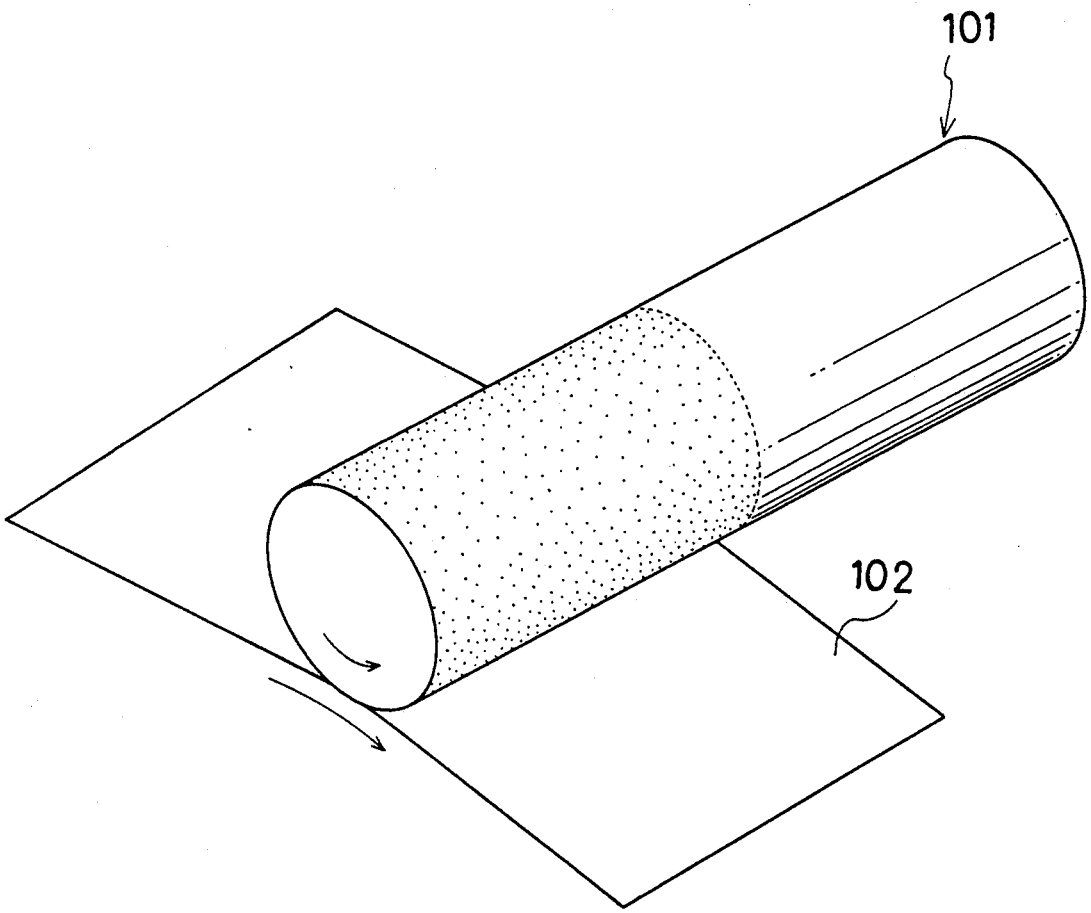
FIG. 10 is a perspective view showing a state where transfer paper is passed through only an approximately half portion of a photosensitive member.

Furthermore, when the transfer paper is thus brought into contact with the surface of each of the photosensitive members, the transfer paper 102 is passed through only an approximately half portion of the photosensitive member 101 as shown in FIG. 10 so as to examine a state where loading material contained in the transfer paper is embedded in the charge transporting layer of the photosensitive member by the contact with the transfer paper.

The above transfer paper 102 is passed 2000 times through the approximately half portion of each of the photosensitive members and then, the photosensitive member is carried on the above described electrophotographic copying machine shown in FIG. 9, to form an image. In forming an image, the amount of exposure of each of the photosensitive members is adjusted to obtain a halftone image having a density of 0.1 which is formed in a portion through which the transfer paper is not passed of the photosensitive member.

In a case where an image is thus formed, if the loading material or the like is embedded in a portion through which the transfer paper is passed of the photosensitive member, the sensitivity of the photosensitive member is lowered in accordance with the amount of the embedded loading material or the like, so that the density of the image formed in the portion through which the paper is passed becomes higher than the density of the image formed in the portion through which the paper is not passed.

The densities of images formed in a portion through which paper is not passed and a portion through which paper is passed of each of the above described photosensitive members are measured, to find the difference ΔID in density between the images. The above densities of the images are measured by a Sakura densitometer PDA65 (trade name) produced by Konishiroku Photo Industry Co., Ltd.

Furthermore, the images obtained in the above described manner are evaluated, to represent by ○ a case where the above difference ΔID in image density is 0.10 or less and sensitivity in the portion through which paper is passed is hardly reduced to obtain a good image, represent by Δ a case where the difference ΔID in image density is over 0.10 up to and including 0.20 and there is some reduction in sensitivity in the portion through which paper is passed to obtain an image which is practically no problem, and represent by X a case where the difference ΔID in image density is more than 0.02 and the reduction in sensitivity in the portion through which paper is passed is recognized to obtain only an image which is practically a problem.

The following table 1 shows the thickness T [μm] of the charge transporting layer of the photosensitive member used in each of the experiments, and the value of $T\cdot(V/N)^{0.1}$, the above difference ΔID in image density and the evaluation of the images in the experiment.

TABLE 1

| experiment | T[μm] | $T\cdot(V/N)^{0.1}$ | ΔID | Evaluation of images |
|---|---|---|---|---|
| 1 | 40 | 31.77 | 0.06 | ○ |
| 2 | 38 | 30.18 | 0.07 | ○ |
| 3 | 36 | 28.60 | 0.08 | ○ |
| 4 | 34 | 27.01 | 0.08 | ○ |
| 5 | 32 | 25.42 | 0.10 | ○ |
| 6 | 30 | 23.83 | 0.12 | Δ |
| 7 | 28 | 22.24 | 0.14 | Δ |
| 8 | 26 | 20.65 | 0.18 | Δ |
| 9 | 24 | 19.06 | 0.23 | X |
| 10 | 22 | 17.48 | 0.29 | X |
| 11 | 20 | 15.89 | 0.34 | X |
| 12 | 18 | 14.30 | 0.38 | X |
| 13 | 16 | 12.71 | 0.40 | X |

As can be seen from the results, in each of the photosensitive members used in the experiments 1 to 8 which satisfy the condition of the above described expression [1], i.e., $T\cdot(V/N)^{0.1}\leqq 20$, the difference in density between the images in the portion through which paper is not passed and the portion through which paper is passed of the photosensitive member is 0.20 or less, so that the amount of the loading material or the like embedded in the portion through which paper is passed of the photosensitive member is smaller, the amount of reduction in sensitivity is smaller and the evaluation of the images formed is superior, as compared with the photosensitive members used in the experiments 9 to 13 which do not satisfy the foregoing condition.

Experiments 14 to 26

In the experiments 13 types of photosensitive members whose charge transporting layers have a Vickers hardness V of 15 and respectively have thicknesses T [μm] of 40, 38, 36, 34, 32, 30, 28, 26, 24, 22, 20, 18 and 16 are used as organic photosensitive members.

Exactly the same experiments as the above described experiments 1 to 13 are conducted with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by eight in the experiments 14 to 26.

The following table 2 shows the thickness T [μm] of the charge transporting layer of the photosensitive member used in each of the experiments, and the value of $T\cdot(V/N)^{0.1}$, the above difference ΔID in image density and the evaluation of the images in the experiment.

TABLE 2

| experiment | T[μm] | $T\cdot(V/N)^{0.1}$ | ΔID | Evaluation of images |
|---|---|---|---|---|
| 14 | 40 | 35.46 | 0.05 | ○ |
| 15 | 38 | 33.69 | 0.05 | ○ |
| 16 | 36 | 31.92 | 0.06 | ○ |
| 17 | 34 | 30.14 | 0.07 | ○ |
| 18 | 32 | 28.37 | 0.08 | ○ |
| 19 | 30 | 26.60 | 0.09 | ○ |
| 20 | 28 | 24.82 | 0.11 | Δ |
| 21 | 26 | 23.05 | 0.14 | Δ |
| 22 | 24 | 21.28 | 0.17 | Δ |
| 23 | 22 | 19.50 | 0.21 | X |
| 24 | 20 | 17.73 | 0.26 | X |
| 25 | 18 | 15.96 | 0.31 | X |
| 26 | 16 | 14.19 | 0.33 | X |

As can be seen from the results, in each of the photosensitive members used in the experiments 14 to 22 which satisfy the condition of the above described expression [1], i.e., $T\cdot(V/N)^{0.1}\leqq 20$, the difference in density between the images in the portion through which paper is not passed and the portion through which paper is passed of the photosensitive member is 0.20 or less, so that the amount of loading material or the like embedded in the portion through which paper is passed of the photosensitive member is smaller, the amount of reduction in sensitivity is smaller and the evaluation of the images formed is superior, as compared with the photosensitive members used in the experiments 23 to 26 which do not satisfy the foregoing condition.

Experiments 27 to 39

In the experiments, 13 types of photosensitive members whose charge transporting layers have a Vickers hardness V of 30 and respectively have thicknesses T [μm] of 40, 38, 36, 34, 32, 30, 28, 26, 24, 22, 20, 18 and 16 are used as organic photosensitive members.

Exactly the same experiments as the above described experiments 1 to 13 are conducted with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by weight in the experiments 27 to 39.

The following table 3 shows the thickness T [μm] of the charge transporting layer of the photosensitive member used in each of the experiments, and the value of $T\cdot(V/N)^{0.1}$, the above difference ΔID in image density and the evaluation of the images in the experiment.

TABLE 3

| experiment | T[μm] | $T\cdot(V/N)^{0.1}$ | ΔID | Evaluation of images |
|---|---|---|---|---|
| 27 | 40 | 38.01 | 0.02 | ○ |
| 28 | 38 | 36.11 | 0.02 | ○ |
| 29 | 36 | 34.21 | 0.03 | ○ |
| 30 | 34 | 32.31 | 0.04 | ○ |

TABLE 3-continued

| experiment | T[μm] | $T \cdot (V/N)^{0.1}$ | ΔID | Evaluation of images |
|---|---|---|---|---|
| 31 | 32 | 30.41 | 0.05 | ○ |
| 32 | 30 | 28.51 | 0.07 | ○ |
| 33 | 28 | 26.61 | 0.09 | ○ |
| 34 | 26 | 24.71 | 0.12 | Δ |
| 35 | 24 | 22.80 | 0.15 | Δ |
| 36 | 22 | 20.90 | 0.18 | Δ |
| 37 | 20 | 19.00 | 0.22 | X |
| 38 | 18 | 17.10 | 0.24 | X |
| 39 | 16 | 15.20 | 0.26 | X |

As can be seen from the results, in each of the photosensitive members used in the experiments 27 to 36 which satisfy the condition of the above described expression [1], i.e., $T \cdot (V/N)^{0.1} \geqq 20$, the difference in density between the images in the portion through which paper is not passed and the portion through which paper is passed of the photosensitive member is 0.20 or less, so that the amount of loading material or the like embedded in the portion through which paper is passed of the photosensitive member is smaller, the amount of reduction in sensitivity is smaller and the evaluation of the images formed is superior, as compared with the photosensitive members used in the experiments 37 to 39 which do not satisfy the foregoing condition.

Experiments 40 to 52

In the experiments, 13 types of photosensitive members whose charge transporting layers have a Vickers hardness V of 50 and respectively have thicknesses T [μm] of 40, 38, 36, 34, 32, 30, 28, 26, 24, 22, 20, 18 and 16 are used as organic photosensitive members.

Exactly the same experiments as the above described experiments 1 to 13 are conducted with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by weight in the experiments 40 to 52.

The following table 4 shows the thickness T [μm] of the charge transporting layer of the photosensitive member used in each of the experiments, and the value of $T \cdot (V/N)^{0.1}$, the above difference ΔID in image density and the evaluation of the images in the experiment.

TABLE 4

| experiment | T[μm] | $T \cdot (V/N)^{0.1}$ | ΔID | Evaluation of images |
|---|---|---|---|---|
| 40 | 40 | 40.00 | 0.01 | ○ |
| 41 | 38 | 38.00 | 0.01 | ○ |
| 42 | 36 | 36.00 | 0.02 | ○ |
| 43 | 34 | 34.00 | 0.03 | ○ |
| 44 | 32 | 32.00 | 0.03 | ○ |
| 45 | 30 | 30.00 | 0.05 | ○ |
| 46 | 28 | 28.00 | 0.07 | ○ |
| 47 | 26 | 26.00 | 0.09 | ○ |
| 48 | 24 | 24.00 | 0.13 | Δ |
| 49 | 22 | 22.00 | 0.17 | Δ |
| 50 | 20 | 20.00 | 0.20 | Δ |
| 51 | 18 | 18.00 | 0.22 | X |
| 52 | 16 | 16.00 | 0.24 | X |

As can be seen from the results, in each of the photosensitive members used in the experiments 40 to 50 which satisfy the condition of the above described expression [1], i.e., $T \cdot (V/N)^{0.1} \geqq 20$, the difference in density between the images in the portion through which paper is not passed and the portion through which paper is passed of the photosensitive member is 0.20 or less. So that the amount of loading material or the like embedded in the portion through which paper is passed of the photosensitive member is smaller, the amount of reduction in sensitivity is smaller and the evaluation of the images formed is superior, as compared with the photosensitive members used in the experiments 51 and 52 which do not satisfy the foregoing condition.

Experiments 53 to 65

In the experiments, 13 types of photosensitive members whose charge transporting layers have a Vickers hardness V of 70 and respectively have thicknesses T [μm] of 40, 38, 36, 34, 32, 30, 28, 26, 24, 22, 20, 18 and 16 are used as organic photosensitive members.

Exactly the same experiments as the above described experiments 1 to 13 are conducted with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by weight in the experiments 53 to 65.

The following table 5 shows the thickness T [μm] of the charge transporting layer of the photosensitive member used in each of the experiments, and the value of $T \cdot (V/N)^{0.1}$, the above difference ΔID in image density and the evaluation of the images in the experiment.

TABLE 5

| experiment | T[μm] | $T \cdot (V/N)^{0.1}$ | ΔID | Evaluation of images |
|---|---|---|---|---|
| 53 | 40 | 41.37 | 0.01 | ○ |
| 54 | 38 | 39.30 | 0.01 | ○ |
| 55 | 36 | 37.23 | 0.01 | ○ |
| 56 | 34 | 35.16 | 0.02 | ○ |
| 57 | 32 | 33.10 | 0.02 | ○ |
| 58 | 30 | 31.03 | 0.04 | ○ |
| 59 | 28 | 28.96 | 0.05 | ○ |
| 60 | 26 | 26.89 | 0.07 | ○ |
| 61 | 24 | 24.82 | 0.11 | Δ |
| 62 | 22 | 22.75 | 0.15 | Δ |
| 63 | 20 | 20.68 | 0.18 | Δ |
| 64 | 18 | 18.62 | 0.21 | X |
| 65 | 16 | 16.55 | 0.22 | X |

As can be seen from the results, in each of the photosensitive members used in the experiments 53 to 63 which satisfy the condition of the above described expression [1], i.e., $T \cdot (V/N)^{0.1} \geqq 20$, the difference in density between the images in the portion through which paper is not passed and the portion through which paper is passed of the photosensitive member is 0.20 or less, so that the amount of loading material or the like embedded in the portion through which paper is passed of the photosensitive member is smaller, the amount of reduction In sensitivity is smaller and the evaluation of the images formed is superior, as compared with the photosensitive members used in the experiments 64 and 66 which do not satisfy the foregoing condition.

Experiments 66 to 78

In the experiments, 13 types of photosensitive members whose charge transporting layers have a Vickers hardness V of 5 and respectively have thicknesses T [μm] of 40, 38, 36, 34, 32, 30, 28, 26, 24, 22, 20, 18 and 16 are used as organic photosensitive members, and regenerated paper having stiffness of 200 measured by the Clark tester is used as transfer paper, as in the above described experiments 1 to 13.

In these experiments, in feeding the above transfer paper so as to come into contact with the surface of each of the above photosensitive members, such adjustments are made that the speed (v) at which the transfer paper is fed is 474 mm/sec, the contact angle $\theta$ at which the transfer paper is brought into contact with the surface of the photosensitive member is 25° and the normal velocity N of the transfer paper which comes into contact with the surface of the photosensitive member is 200 mm/sec and then, the experiments are conducted in the same manner as the above experiments 1 to 13, to find the difference ΔID in density between images formed in a portion through which paper is not passed and a portion through which paper is passed of the photosensitive member as well as to evaluate the images obtained.

The following table 6 shows the thickness T [μm] of the charge transporting layer of the photosensitive member used in each of the experiments, and the value of $T\cdot(V/N)^{0.1}$, the above difference ΔID in image density and the evaluation of the images in the experiment.

TABLE 6

| experiment | T[μm] | $T\cdot(V/N)^{0.1}$ | ΔID | Evaluation of images |
|---|---|---|---|---|
| 66 | 40 | 27.66 | 0.09 | ○ |
| 67 | 38 | 26.28 | 0.09 | ○ |
| 68 | 36 | 24.89 | 0.11 | Δ |
| 69 | 34 | 23.51 | 0.13 | Δ |
| 70 | 32 | 22.13 | 0.15 | Δ |
| 71 | 30 | 20.75 | 0.18 | Δ |
| 72 | 28 | 19.36 | 0.22 | X |
| 73 | 26 | 17.98 | 0.28 | X |
| 74 | 24 | 16.6 | 0.36 | X |
| 75 | 22 | 15.21 | 0.42 | X |
| 76 | 20 | 13.83 | 0.45 | X |
| 77 | 18 | 12.45 | 0.46 | X |
| 78 | 16 | 11.06 | 0.48 | X |

As can be seen from the results, in each of the photosensitive members used in the experiments 66 to 71 which satisfy the condition of the above described expression [1], i.e., $T\cdot(V/N)^{0.1}\geqq 20$, the difference in density between the images in the portion through which paper is not passed and the portion through which paper is passed of the photosensitive member is 0.20 or less, so that the amount of loading material or the like embedded in the portion through which paper is passed of the photosensitive member is smaller, the amount of reduction in sensitivity is smaller and the evaluation of the images formed is superior, as compared with the photosensitive members used in the experiments 72 to 78 which do not satisfy the foregoing condition.

Experiments 79 to 91

In the experiments, 13 types of photosensitive members whose charge transporting layers have a Vickers hardness V of 15 and respectively have thicknesses T [μm] of 40, 38, 36, 34, 32, 30, 28, 26, 24, 22, 20, 18 and 16 are used as organic photosensitive members.

The experiments are conducted in exactly the same manner as the above described experiments 1 to 13 with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by weight in the experiments 79 to 91.

The following table 7 shows the thickness T [μm]of the charge transporting layer of the photosensitive member used in each of the experiments, and the value of $T\cdot(V/N)^{0.1}$, the above difference ΔID in image density and the evaluation of the images in the experiment.

TABLE 7

| experiment | T[μm] | $T\cdot(V/N)^{0.1}$ | ΔID | Evaluation of images |
|---|---|---|---|---|
| 79 | 40 | 30.87 | 0.07 | ○ |
| 80 | 38 | 29.33 | 0.08 | ○ |
| 81 | 36 | 27.78 | 0.09 | ○ |
| 82 | 34 | 26.24 | 0.10 | ○ |
| 83 | 32 | 24.7 | 0.11 | Δ |
| 84 | 30 | 23.15 | 0.13 | Δ |
| 85 | 28 | 21.61 | 0.15 | Δ |
| 86 | 26 | 20.07 | 0.19 | Δ |
| 87 | 24 | 18.52 | 0.24 | X |
| 88 | 22 | 16.98 | 0.29 | X |
| 89 | 20 | 15.44 | 0.34 | X |
| 90 | 18 | 13.89 | 0.36 | X |
| 91 | 16 | 12.35 | 0.38 | X |

As can be seen from the results, in each of the photosensitive members used in the experiments 79 to 86 which satisfy the condition of the above described expression [1], i e., $T\cdot(V/N)^{0.1}\geqq 20$, the difference in density between the images in the portion through which paper is not passed and the portion through which paper is passed of the photosensitive member is 0.20 or less, so that the amount of loading material or the like embedded in the portion through which paper is passed of the photosensitive member is smaller, the amount of reduction in sensitivity is smaller and the evaluation of the images formed is superior, as compared with the photosensitive members used in the experiments 87 to 91 which do not satisfy the foregoing condition.

Experiments 92 to 104

In the experiments, 13 types of photosensitive members whose charge transporting layers have a Vickers hardness V of 30 and respectively have thicknesses T [μm] of 40, 88, 36, 34, 32, 30, 28, 26, 24, 22, 20, 18 and 16 are used as organic photosensitive members.

The experiments are conducted in exactly the same manner as the above described experiments 66 to 78 with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by weight in the experiments 92 to 104.

The following table 8 shows the thickness T [μm] of the charge transporting layer of the photosensitive member used in each of the experiments, and the value of $T \cdot (V/N)^{0.1}$, the above difference ΔID in image density and the evaluation of the images in the experiment.

TABLE 8

| experiment | T[μm] | $T \cdot (V/N)^{0.1}$ | ΔID | Evaluation of images |
|---|---|---|---|---|
| 92 | 40 | 33.09 | 0.02 | ○ |
| 93 | 38 | 31.43 | 0.03 | ○ |
| 94 | 36 | 29.78 | 0.04 | ○ |
| 95 | 34 | 28.12 | 0.06 | ○ |
| 96 | 32 | 26.47 | 0.09 | ○ |
| 97 | 30 | 24.82 | 0.12 | Δ |
| 98 | 28 | 23.16 | 0.15 | Δ |
| 99 | 26 | 21.51 | 0.20 | Δ |
| 100 | 24 | 19.85 | 0.24 | X |
| 101 | 22 | 18.2 | 0.27 | X |
| 102 | 20 | 16.54 | 0.29 | X |
| 103 | 18 | 14.89 | 0.31 | X |
| 104 | 16 | 13.24 | 0.32 | X |

As can be seen from the results, in each of the photosensitive members used in the experiments 92 to 99 which satisfy the condition of the above described expression [1], i.e., $T \cdot (V/N)^{0.1} \geqq 20$, the difference in density between the images in the portion through which paper is not passed and the portion through which paper is passed of the photosensitive member is 0.20 or less, so that the amount of loading material or the like embedded in the portion through which paper is passed of the photosensitive member is smaller, the amount of reduction in sensitivity is smaller and the evaluation of the images formed is superior, as compared with the photosensitive members used in the experiments 100 to 104 which do not satisfy the foregoing condition.

Experiments 105 to 117

In the experiments, 13 types of photosensitive members whose charge transporting layers have a Vickers hardness V of 50 and respectively have thicknesses T [μm] of 40, 38, 36, 34, 32, 30, 28, 26, 24, 22, 20, 18 and 16 are used as organic photosensitive members.

The experiments are conducted in exactly the same manner as the above described experiments 66 to 78 with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by weight in the experiments 105 to 117.

The following table 9 shows the thickness T [μm] of the charge transporting layer of the photosensitive member used in each of the experiments, and the value of $T \cdot (V/N)^{0.1}$, the above difference ΔID in image density and the evaluation of the images in the experiment.

TABLE 9

| experiment | T[μm] | $T \cdot (V/N)^{0.1}$ | ΔID | Evaluation of images |
|---|---|---|---|---|
| 105 | 40 | 34.82 | 0.01 | ○ |

TABLE 9-continued

| experiment | T[μm] | $T \cdot (V/N)^{0.1}$ | ΔID | Evaluation of images |
|---|---|---|---|---|
| 106 | 38 | 33.08 | 0.02 | ○ |
| 107 | 36 | 31.34 | 0.03 | ○ |
| 108 | 34 | 29.6 | 0.05 | ○ |
| 109 | 32 | 27.86 | 0.07 | ○ |
| 110 | 30 | 26.12 | 0.09 | ○ |
| 111 | 28 | 24.38 | 0.12 | Δ |
| 112 | 26 | 22.63 | 0.15 | Δ |
| 113 | 24 | 20.89 | 0.18 | Δ |
| 114 | 22 | 19.15 | 0.22 | X |
| 115 | 20 | 17.41 | 0.25 | X |
| 116 | 18 | 15.67 | 0.27 | X |
| 117 | 16 | 13.93 | 0.28 | X |

As can be seen from the results, in each of the photosensitive members used in the experiments 105 to 113 which satisfy the condition of the above described expression [1], i.e., $T \cdot (V/N)^{0.1} \geqq 20$, the difference in density between the images in the portion through which paper is not passed and the portion through which paper is passed of the photosensitive member is 0.20 or less, so that the amount of loading material or the like embedded in the portion through which paper is passed of the photosensitive member is smaller, the amount of reduction in sensitivity is smaller and the evaluation of the images formed is superior, as compared with the photosensitive members used in the experiments 114 to 117 which do not satisfy the foregoing condition.

Experiments 118 to 130

In the experiments, 13 types of photosensitive members whose charge transporting layers have a Vickers hardness of 70 and respectively have thicknesses T [μm] of 40, 38, 36, 34, 32, 30, 28, 26, 24, 22, 20, 18 and 16 are used as organic photosensitive members.

The experiments are conducted in exactly the same manner as the above described experiments 66 to 78 with respect to the above described photosensitive members, to find the difference ΔID in density between images formed in a portion through which paper is not passed and a portion through which paper is passed of each of the photosensitive members as well as to evaluate the images obtained. In addition, as transfer paper, regenerated paper having stiffness ($L^3/100$) of 200 measured by the Clark tester and having a wastepaper content of 50% and an ash content of 21% by weight in the experiments 118 to 130.

The following table 10 shows the thickness T [μm] of the charge transporting layer of the photosensitive member used in each of the experiments, and the value of $T \cdot (V/N)^{0.1}$, the above difference ΔID in image density and the evaluation of the images in the experiment.

TABLE 10

| experiment | T[μm] | $T \cdot (V/N)^{0.1}$ | ΔID | Evaluation of images |
|---|---|---|---|---|
| 118 | 40 | 36.01 | 0.01 | ○ |
| 119 | 38 | 34.21 | 0.01 | ○ |
| 120 | 36 | 32.41 | 0.02 | ○ |
| 121 | 34 | 30.61 | 0.03 | ○ |
| 122 | 32 | 28.81 | 0.05 | ○ |
| 123 | 30 | 27.01 | 0.07 | ○ |
| 124 | 28 | 25.21 | 0.10 | ○ |
| 125 | 26 | 23.41 | 0.14 | Δ |
| 126 | 24 | 21.61 | 0.18 | Δ |
| 127 | 22 | 19.81 | 0.22 | X |
| 128 | 20 | 18.01 | 0.24 | X |
| 129 | 18 | 16.21 | 0.26 | X |

TABLE 10-continued

| experiment | T[μm] | $T \cdot (V/N)^{0.1}$ | ΔID | Evaluation of images |
|---|---|---|---|---|
| 130 | 16 | 14.41 | 0.28 | X |

As can be seen from the results, in each of the photosensitive members used in the experiments 118 to 126 which satisfy the condition of the above described expression [1], i.e., $T \cdot (V/N)^{0.1} \geqq 20$, the difference in density between the images in the portion through which paper is not passed and the portion through which paper is passed of the photosensitive member is 0.20 or less, so that the amount of loading material or the like embedded in the portion through which paper is passed is smaller, the reduction in sensitivity is smaller and the evaluation of the images formed is superior, as compared with the photosensitive members used in the experiments 127 to 130 which do not satisfy the foregoing condition.

Experiments 131 to 134

In the experiments, organic photosensitive members whose charge transporting layers have a Vickers hardness V of 50 and have a thickness T [μm] of 30 μm are used, and the same regenerated paper having stiffness of 200 measured by the Clark tester as that in each of the above described experiments is used as transfer paper.

In feeding the transfer paper so as to come into contact with the surface of each of the above photosensitive members, such adjustments are made that the speed (v) at which the transfer paper is fed is 385 mm/sec and the contact angle θ at which the transfer paper is brought into contact with the surface of the photosensitive member is 15° in the experiment 131, while the speed (v) at which the transfer paper is fed is 293 mm/sec and the contact angle θ at which the transfer paper is brought into contact with the surface of the photosensitive member is 20° in the experiment 132, and the normal velocity N of the transfer paper which comes into contact with the surface of the photosensitive member is 100 mm/sec in both the experiments. In these cases, the value of $T \cdot (V/N)^{0.2}$ is 27.99.

Furthermore, such adjustments are made that the speed (v) at which the transfer paper is fed is 439 mm/sec and the contact angle θ at which the transfer paper is brought into contact with the surface of the photosensitive member is 20° in the experiment 133, while the speed (v) at which the transfer paper is fed is 356 mm/sec and the contact angle θ at which the transfer paper is brought into contact with the surface of the photosensitive member is 25° in the experiment 134, and the normal velocity N of the transfer paper which comes into contact with the surface of the photosensitive member is 100 mm/sec in both the experiments. In these cases, the value of $T \cdot (V/N)^{0.1}$ is 26.88.

These experiments 131 to 134 are conducted in the same manner as the above described experiments 1 to 13 under the foregoing conditions, to find the difference ΔID in density between images formed in a portion through which paper is not passed and a portion through which paper is passed of each of the photosensitive members as well as to evaluate the images obtained.

As a result, in both the experiments 131 and 132 in which the value of $T \cdot (V/N)^{0.1}$ becomes 27.99, the difference ΔID in image density is low, i.e., 0.06, and the amount of reduction in sensitivity in the portion through which paper is passed of the photosensitive member is small, to obtain a good image.

On the other hand, also in the experiments 138 and 134 in which the value of $T \cdot (V/N)^{0.1}$ becomes 26.88, the difference ΔID in image density is low. i.e., 0.088, and the amount of reduction in sensitivity in the portion through which paper is passed of the photosensitive member is small, to obtain a good image.

As obvious from the results, even if the speed (v) at which the transfer paper is fed and the contact angle θ at which the transfer paper is brought into contact with the surface of the photosensitive member are altered, the amount of loading material or the like in the portion through which paper is passed of the photosensitive member is small so long as the condition of the above described expression [1], i.e., $T \cdot (V/N)^{0.1} \geqq 20$ is satisfied, to obtain an image which is hardly irregular in density.

Additionally, even if the speed (v) at which the transfer paper is fed and the contact angle θ at which the transfer paper is brought into contact with the surface of the photosensitive member respectively vary, almost the same results are obtained provided that the normal velocity N of the transfer paper which comes into contact with the surface of the photosensitive member is the same.

Experiments 135 to 138

In the experiments, organic photosensitive members are used whose charge transporting layers have a Vickers hardness V of 50 and have a thickness T of 30 μm.

On the other hand, as transfer paper, regenerated paper having stiffness ($L^3/100$) of 250 measured by the Clark tester and having a wastepaper content of 80% and an ash content of 25% by weight is used in the experiment 135, regenerated paper having the above stiffness of 300 and having a wastepaper content of 80% and an ash content of 28% by weight is used in the experiment 136, regenerated paper having the above stiffness of 350 and having a wastepaper content of 90% and an ash content of 31% by weight is used in the experiment 137, and regenerated paper having the above stiffness of 400 and having a wastepaper content of 95% and an ash content of 32%2 by weight is used in the experiment 138.

In the experiments 135 to 138, in feeding the transfer paper so as to come into contact with the surface of each of the above described photosensitive members, the speed (v) at which the transfer paper is fed is set to 192 mm/sec and the contact angle θ at which the transfer paper is brought into contact with the surface of the photosensitive member is set to 15°. In this case, the value of $T \cdot (V/N)^{0.1}$ is 30.00.

The experiments 131 to 134 are conducted in the same manner as the above described experiments 1 to 13 under the foregoing conditions, to find the difference ΔID in density between images formed in a portion through which paper is not passed and a portion through which paper is passed of each of the photosensitive members as well as to evaluate the images obtained.

As a result, the difference in density between the images in the portion through which paper is not passed and the portion through which paper is passed of the photosensitive member is low, i.e., 0.05 in the experiment 135, 0.06 in the experiment 136, 0.06 in the experiment 137 and 0.05 in the experiment 138, and the amount of reduction in sensitivity in the portion through which paper is passed of the photosensitive member is small in the experiments, to obtain a good image.

The results show that even when regenerated paper having high stiffness measured by the Clark tester and having a large wastepaper content and ash content is used, the amount of loading material or the like embedded in the portion through which paper is passed of the photosensitive member is small, the reduction in sensitivity of the photosensitive member due to the embedding of the loading material or the like is restrained, and the difference ΔID in density between the images in the portion through which paper is not passed and the portion through which paper is passed of the photosensitive member is small, to obtain an image which is hardly irregular in density.

Furthermore, when judgement is collectively made from the foregoing results of all the experiments, it is found that more favorable results are obtained when the value of $T\cdot(V/N)^{0.1}$ is 25 or more.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming method comprising the steps of:

forming an electrostatic latent image on a photosensitive member having a surface layer containing binder resin and photosensitive material dispersed in said binder resin, said surface layer having a thickness (t) (μm) and a Vickers hardness (V);

supplying charged toner particles to said electrostatic latent image, to form a toner image on said photosensitive member; and conveying paper toward the surface of said photosensitive member, to engage the paper with said toner image so that said paper is conveyed to the surface of the photosensitive member at a speed of (v) (mm/sec) and is brought into contact with the surface of the photosensitive member at a contact angle of θ (degrees) formed between an angle of approach of the paper and a tangential surface of the photosensitive member, wherein a relationship among a normal velocity (N) (mm/sec) of the paper with respect to the tangential surface of the photosensitive member, which is defined by the formula of (v) sin θ, the thickness (T) (μm) and the Vickers hardness (V) satisfies the condition of $T\cdot(V/N)^{0.1} \geqq 20$.

2. The image forming method according to claim 1, wherein said paper has Clark stiffness of 180 to 450 measured by the TAPPI standard test of T 451 regulation and has an ash content of 20 to 40 percent by weight.

3. The image forming method according to claim 1, wherein charge transporting material is dispersed as the photosensitive material in the binder resin in the surface layer of said photosensitive member, and a charge generating layer containing charge generating material is provided below the surface layer.

4. The image forming method according to claim 3, wherein the binder resin in the surface layer of said photosensitive member is polycarbonate resin or polyester resin.

5. An image forming method comprising the steps of:

forming an electrostatic latent image of a photosensitive member having a surface layer containing binder resin and photosensitive material dispersed in said binder resin, wherein a thickness (T) (μm) of said surface layer is formed to satisfy the condition of $10 \leqq V \leqq 100$ and a Vickers hardness of said surface layer is formed to satisfy the condition of $4 \leqq V \leqq 80$;

supplying charged toner particles to said electrostatic latent image, to form a toner image on said photosensitive member;

conveying paper toward the surface of said photosensitive member, to engage the paper with said toner image so that said paper is conveyed to the surface of the photosensitive member at a speed of (v) (mm/sec) and is brought into contact with the surface of the photosensitive member at a contact angle of θ (degrees) formed between an angle of approach of the paper and a tangential surface of the photosensitive member, wherein a relationship among a normal velocity (N) (mm/sec) of the paper with respect to the tangential surface of the photosensitive member, which is defined by the formula of (v) sin θ satisfying the condition of $30 \leqq N \leqq 600$, the thickness of (T) (μm) and the Vickers hardness (V) satisfies the condition of $20 \leqq T\cdot(V/N)^{0.1} \leqq 110$; and transferring the toner image formed on the photosensitive member to said paper.

6. The image forming method according to claim 5, wherein said step of transferring the toner image formed on the photosensitive member to the paper is carried out by applying charges having opposite polarity to said toner particles from the position spaced apart from the paper and on the opposite side of the paper with respect to said photosensitive material.

7. The image forming method according to claim 5, wherein said paper has Clark stiffness of 180 to 450 measured by the TAPPI standard test of T 451 regulation and has an ash content of 20 to 40 percent by weight.

8. An image forming method using an electrophotographic process, wherein an electrostatic latent image formed on the surface of a cylindrical photosensitive member rotating with a peripheral speed of (v) (mm/sec) is passed through a series of processing stations including a developing station and a transferring station, comprising the steps of:

supplying charged toner particles to the electrostatic latent image formed on the surface of said photosensitive member, to form a toner image on the photosensitive member at said developing station, wherein said photosensitive member has a surface layer comprising binder resin as a main component, said surface layer having a thickness of T (μm) and a Vickers hardness (V);

conveying the paper toward the surface of said photosensitive member, to engage the paper with said toner image so that said paper is conveyed along the peripheral direction of the photosensitive member at the same speed of (v) as the peripheral speed of the photosensitive member and is brought into contact with the surface of the photosensitive member at a contact angle of (θ) (degrees) formed between an angle of approach of the paper and a tangential surface of the photosensitive member, wherein a relationship among the normal velocity (N) (mm/sec) of the paper with respect to the tangential surface of the photosensitive member, which is defined by the formula of (v) sin $\theta$, and the thickness (T) ($\mu$m) and the Vickers hardness (V) satisfies the condition of $T \cdot (V/N)^{0.1} \geqq 20$; and transferring the toner image formed on the photosensitive member to said paper.

9. The image forming method according to claim 8, wherein said step of transferring the toner image formed on the photosensitive member to the paper is carried out by applying charges having opposite polarity to said toner particles from the position spaced apart from the paper and on the opposite side of the paper with respect to said photosensitive material.

10. The image forming method according to claim 8, wherein said paper has Clark stiffness of 180 to 450 measured by the TAPPI standard test of T 451 regulation and has an ash content of 20 to 40 percent by weight.

11. The image forming method according to claim 10, wherein the thickness (T) [$\mu$m] of said surface layer satisfies the condition of $10 \leqq T \leqq 100$, and the Vickers hardness (v) of the surface layer satisfies the condition of $4 \leqq V \leqq 80$.

12. The image forming method according to claim 11, wherein the normal velocity (N) [mm/sec] of said paper satisfies the condition of $30 \leqq N \leqq 600$.

* * * * *